United States Patent [19]

Schwab

[11] Patent Number: 4,770,023

[45] Date of Patent: Sep. 13, 1988

[54] RIVET SETTING TOOL

[75] Inventor: Manfred Schwab, Taunusstein, Fed. Rep. of Germany

[73] Assignee: Alfred Honsel Nieten- und Metallwarenfabrik GmbH & Co., Frondenberg, Fed. Rep. of Germany

[21] Appl. No.: 63,141

[22] PCT Filed: Sep. 13, 1986

[86] PCT No.: PCT/EP86/00527

§ 371 Date: May 4, 1987

§ 102(e) Date: May 4, 1987

[87] PCT Pub. No.: WO87/01630

PCT Pub. Date: Mar. 26, 1987

[30] Foreign Application Priority Data

Sep. 14, 1985 [DE] Fed. Rep. of Germany ..... 3532932

[51] Int. Cl.[4] ..... B21J 15/20

[52] U.S. Cl. ..... 72/391; 72/453.17; 21/243.53

[58] Field of Search ..... 72/391, 114, 453.17, 72/453.19; 29/243.53

[56] References Cited

U.S. PATENT DOCUMENTS

| | | | |
|---|---|---|---|
| 3,555,649 | 1/1971 | Rigot . | |
| 3,563,438 | 2/1971 | Doyle . | |
| 4,027,520 | 6/1977 | Klein | 72/391 |
| 4,130,006 | 12/1978 | Ebbert . | |
| 4,515,005 | 5/1985 | Klein | 72/391 |
| 4,580,435 | 4/1986 | Port et al. | 72/391 |
| 4,704,888 | 11/1987 | Frearson | 72/391 |

FOREIGN PATENT DOCUMENTS

| | | | |
|---|---|---|---|
| A120309 | 10/1984 | European Pat. Off. . | |
| 1949951 | 4/1970 | Fed. Rep. of Germany | 72/391 |
| 1393491 | 2/1965 | France . | |
| 2253583 | 4/1975 | France . | |

*Primary Examiner*—David Jones

*Attorney, Agent, or Firm*—Barnes, Kisselle, Raisch, Choate, Whittemore & Hulbert

[57] ABSTRACT

A rivet setting tool having a feed mechanism which can be actuated for a rivet setting operation and which imparts an axial movement to a screwthreaded or tensile pin. The feed mechanism comprises a piston cylinder assembly formed by a working piston and a pressing piston. Both pistons are returned to their initial positions by pressure fluid being conducted to the rear sides thereof, thus avoiding the use of return springs acting on the pistons. To provide that effect, a pressure fluid passage extends from the pressure fluid inlet through the handle portion of the tool to a rearward chamber provided behind the working piston and defined at one side thereof by the rearward face of the piston, thereby to urge the working piston towards its initial position, while a further communication urges the pressing piston also towards its initial position.

9 Claims, 3 Drawing Sheets

RIVET SETTING TOOL

BACKGROUND OF THE INVENTION

In one form of rivet setting tool for setting screwthreaded rivet nuts or blind rivet nuts, referred to hereinafter for the sake of simplicity as rivet nuts, the tool comprises a forward feed arrangement for imparting an axial movement to the screw-threaded pin or tensile pin, the forward feed arrangement being actuable to perform the rivet nut upsetting operation. The forward feed arrangement comprises a piston cylinder assembly including a pressing piston and a working piston.

In such a tool, the working movement of the pressing piston and the working piston is produced by an external compressed air source, while the return movement of those pistons is produced by springs. The springs required for that purpose are disadvantageous from various points of view. Apart from the fact that the spring force may gradually become weaker due to fatigue in the course of a prolonged period of time or the springs may even become defective, for example they may break, so that the pistons are then no longer satisfactorily returned, there is also the problem that springs of suitable quality are very expensive and also give rise to further labour costs in assembly of the tool. Furthermore, a spring can only exert a given force so that that consideration also limits the speed at which the return movement of the pistons may be effected.

SUMMARY OF THE INVENTION

An object of the present invention is to provide a rivet setting tool which can be produced inexpensively and with a low level of assembly cost.

Another object of the present invention is to provide a rivet setting tool which is comparatively inexpensive but which nonetheless operates with a high degree of reliability and with a high working speed.

In accordance with the present invention, those and other objects are achieved by a rivet setting tool for setting screw-threaded rivet nuts or blind rivet nuts, comprising a feed means which can be actuated for the rivet upsetting operation and which imparts an axial movement to the screwthreaded pin or the tensile pin of the rivet member to be set. The feed means comprises a piston-cylinder assembly comprising a pressing piston and a working piston. The return movement of the pressing piston and the working piston, after operation of the tool, is produced by conducting the operating pressure fluid of the tool to the rear sides of the respective pistons, thus providing for return movement thereof without using return springs to produce such movement. Furthermore, a pressure fluid passage extends from the pressure fluid inlet means of the tool, through the handle portion of the tool, to a rearward chamber which is thus disposed at the rearward side of the working piston and which is closed off by the rearward face thereof, that is to say, the face of the working piston which is remote from the operating tip portion of the tool where the rivet member to be set is held.

Further objects, features and advantages of a rivet setting tool in accordance with the present invention will be apparent from the following description of a preferred embodiment thereof.

DESCRIPTION OF THE PREFERRED EMBODIMENT

Figure 1:
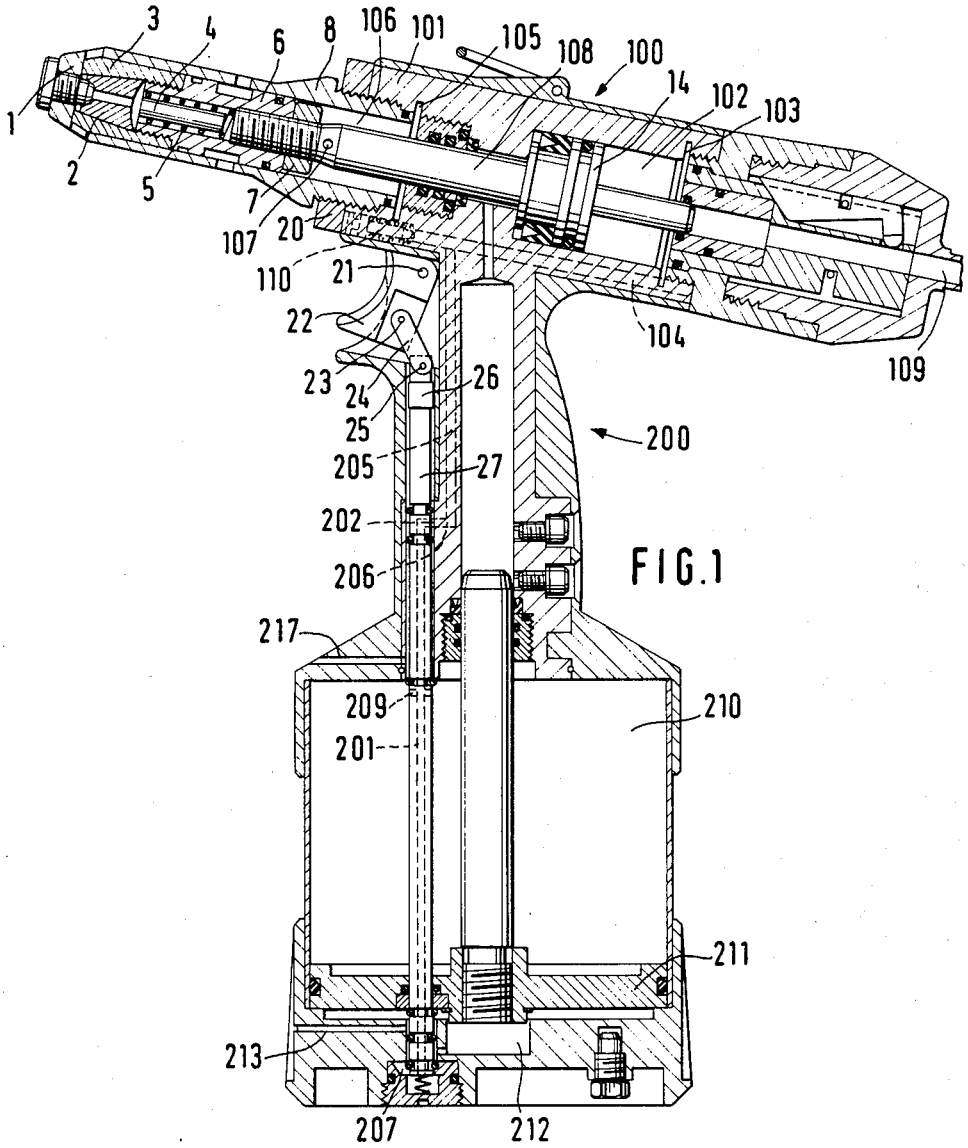
FIG. 1 is a sectional side view of a rivet setting tool according to the invention, in the unactuated condition.
Figure 2:
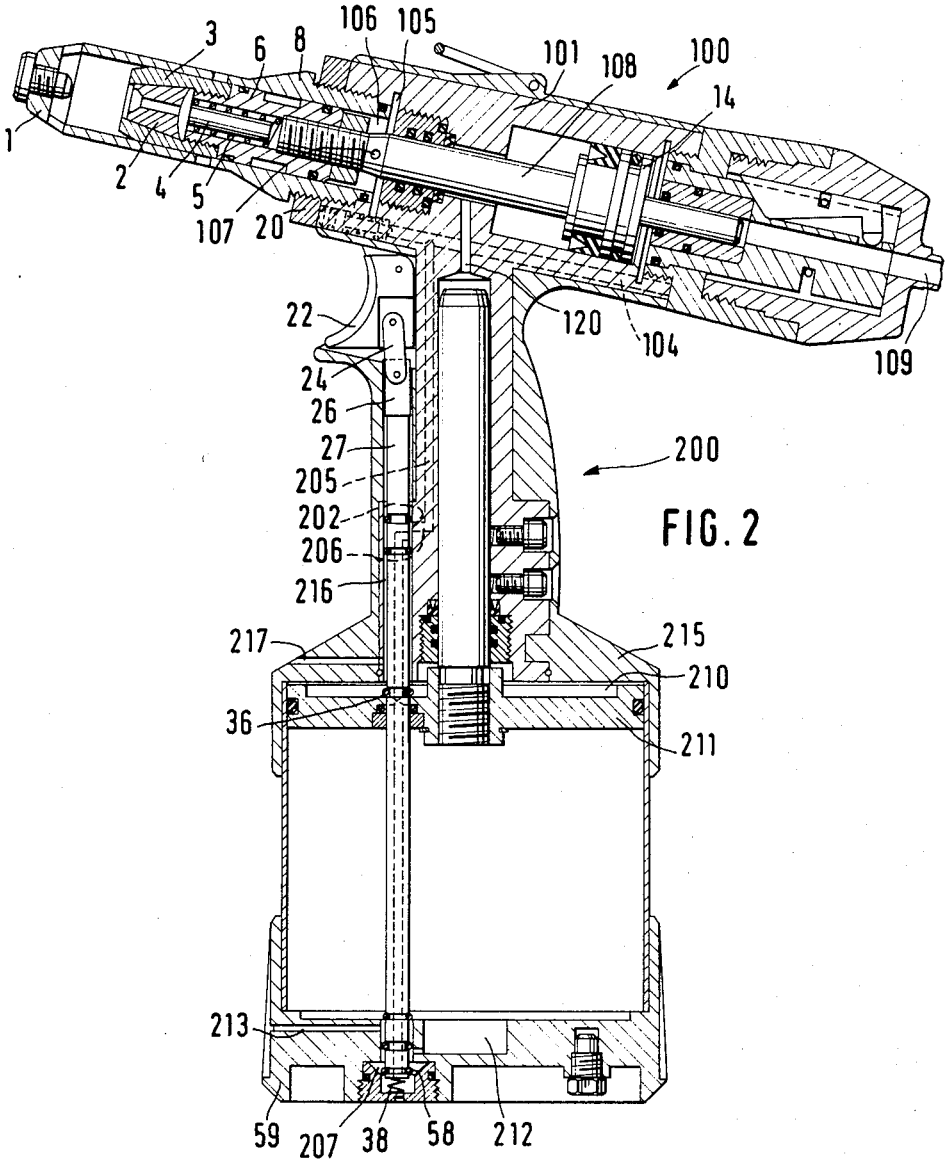
FIG. 2 is a view corresponding to that shown in FIG. 1 of the rivet setting tool in the actuated condition.

Referring firstly to FIG. 1, shown therein in an unactuated or inoperative condition is a rivet setting tool for setting screwthreaded rivet nuts or blind rivet nuts, comprising a body portion indicated generally by reference numeral 100, and a gripping or handle portion 200 which is formed on the body portion 100. At its forward end, to the left in FIGS. 1 and 2, the body portion 100 comprises a mouthpiece 1. Arranged rearwardly of the mouthpiece 1, that is to say, on the right thereof as shown in FIGS. 1 and 2, is a clamping chuck comprising clamping jaws 2 which are surrounded by a conical clamping sleeve 3. A guide sleeve 4 which is disposed coaxially with the clamping chuck 2, 3 is surrounded by a compression coil spring 5. An intermediate portion 6 which is also coaxial with the clamping chuck 2, 3 is fixed in position by means of a lock nut 7.

The whole of the front part of the body portion 100 is enclosed by a forward sleeve portion 8 which is fixed in the housing 101 of the body portion 100.

Disposed in the rearward part of the housing 101, which is thus towards the right in FIGS. 1 and 2, is an operating or working piston 14 which is for example a hydraulic piston. On its rearward side, which is towards the right in FIGS. 1 and 2, the working piston 14 defines one side of a rearward chamber 102 which communicates by way of a recess 103 in the housing 101, with a passage or duct 104 which extends in the body portion 100 of the tool. Communicating with the passage 104 in the body portion 100 is a further duct or passage 205 which extends through the handle portion 200 and thus runs vertically in for example FIG. 1. At its lower end, the passage 205 in the handle portion 200 communicates with a transverse passage 206.

The handle portion 200 carries an actuating member illustrated in the form of a trigger 22 which is movably mounted to the handle portion 200 by way of a cylindrical pin 21 acting as a pivot. A lever 24 has one end thereof pivotally connected to the trigger 22 by means of a cylindrical pivot pin 23 while at its other end the lever 24 is connected by means of a cylindrical pivot pin 25 to a valve pin 26 which is disposed on a valve rod 27. The valve rod 27 extends vertically downwardly in for example FIG. 1, towards a pressure fluid inlet means as indicated at 207.

In its lower portion, the valve rod 27 is provided with a duct or passage 201 which is in the form of a central bore therein and which at its upper end opens to the exterior laterally at an outlet as indicated at 202.

An air inlet duct or hose which is not shown in the drawings feeds pressure fluid in the form of compressed air into the compressed air inlet means at an air chamber 207 from which the compressed air flows into the passage 201 in the valve rod 27, and issues at 202. In the first position of the tool as shown in FIG. 1, which is the unactuated condition, the outlet 202 of the passage 201 in the valve rod 27 is aligned with the above-mentioned transverse passage 206 communicating with the passage 205 in the handle portion 200 so that the compressed air can flow by way of the passage 206 and the passage 104 in the body portion 100 into the rearward chamber 102 at the rear of the working piston 14. The pressure of the compressed air causes the working piston 14 to be moved towards the left in FIG. 1. In addition, the air from the passage 104 in the body portion 100 flows towards the left in FIG. 1, to a recess or opening 105 in the housing 101 and from there into a suction chamber 106 and then by way of bores 107 into the interior of the piston rod 108 which is connected to the working piston 14. There, the air serves for sucking the rivet unless, depending on the design configuration of the tool, the operation to be performed is that of screwing on a screwthreaded rivet nut.

In addition, the air flowing through the bores 107 in the piston rod 108 is available for removing the rivet pins rearwardly through the passage 109 which is indicated at the right in FIGS. 1 and 2. The tool also includes an adjusting valve 110 for steplessly adjusting the strength of the air flow and thus the force produced by the air, insofar as the valve 110 can be suitably adjusted by means of a cap nut 20 or an adjusting screw which is not illustrated in the drawings.

In addition, the air flowing through the passage 201 in the valve rod 27 flows through a lower transverse passage 209 in the valve rod 27 into a pressure chamber 210 associated with a pressing piston 211, the chamber 210 being disposed above the pressing piston 211 and thus being disposed at the rear thereof, in the operative direction of movement of the pressing piston 211 which is upwardly in FIGS. 1 and 2. As a result of the air flowing into the rearward pressure chamber 210, the piston 211 is urged downwardly in FIG. 1. The chamber 212 on the other side of the piston 211, is relieved through a vent passage 213.

Reference will now be made more specifically to FIG. 2 which shows the same rivet setting tool as that shown in FIG. 1 so that the same reference numerals are used to denote the same parts. In FIG. 2 however the rivet setting tool is in a second or operated position in which the trigger 22 has been actuated so that the valve rod 27 is moved downwardly against the force of a compression spring 38, by way of the interconnection by means of the lever 24. A comparison between FIGS. 1 and 2 will clearly show that pivotal movement of the trigger 22 about the pivot pin 21 causes the lever 24 to move from the inclined position in FIG. 1 into the substantially vertical position in FIG. 2 in which it therefore displaces the valve rod 27 downwardly.

By virtue of that movement, a seal 36 carried on the valve rod 27 is moved away from a housing portion 215 which forms part of the handle portion 200 so that the passage 205 in the handle portion 200 is vented by way of the bore 216 in which the valve rod 27 is carried and a vent passage 217 communicating therewith; that also results in venting of the rearward chamber 102 which is to the right of the working piston 14, by way of the passage 104 in the body portion 100, the passage 104 communicating with the passage 205 in the handle portion 200, as described above.

In addition, a sealing ring 58 which is disposed at the lower end of the valve rod 27 is moved away from its condition of bearing against a closure cover 59 so that the compressed air flows from the inlet chamber 207 into the front chamber 212 of the pressing piston 211 and thus urges the piston 211 upwardly in FIG. 2. As a result of that movement, a hydraulic medium is operative, by way of the pressure passage 120 which is clearly visible in FIG. 2, to move the working piston 14 towards the right and thus into the position shown in FIG. 2, thereby performing the rivet setting operation. After that operation, the trigger 22 is released. The compression spring 38 at the bottom of the tool as viewed in FIG. 2 causes the valve rod 27 to be displaced upwardly again whereby the working piston 14 and the pressing piston 211 return to their positions shown in FIG. 1, by the vent bore 217 being closed and the vent bore 213 being opened. It will be seen therefore that the abovedescribed construction provides that the pressing piston 211 and the working piston 14 are returned to their starting positions for a setting operation by conducting pressure fluid to the rearward sides of the respective pistons 211 and 14, that is to say, by conducting pressure fluid into the chambers 210 and 102 respectively. That construction therefore does not require any return springs acting directly on the pistons 211 and 14 to produce the return movement thereof.

Figure 3:
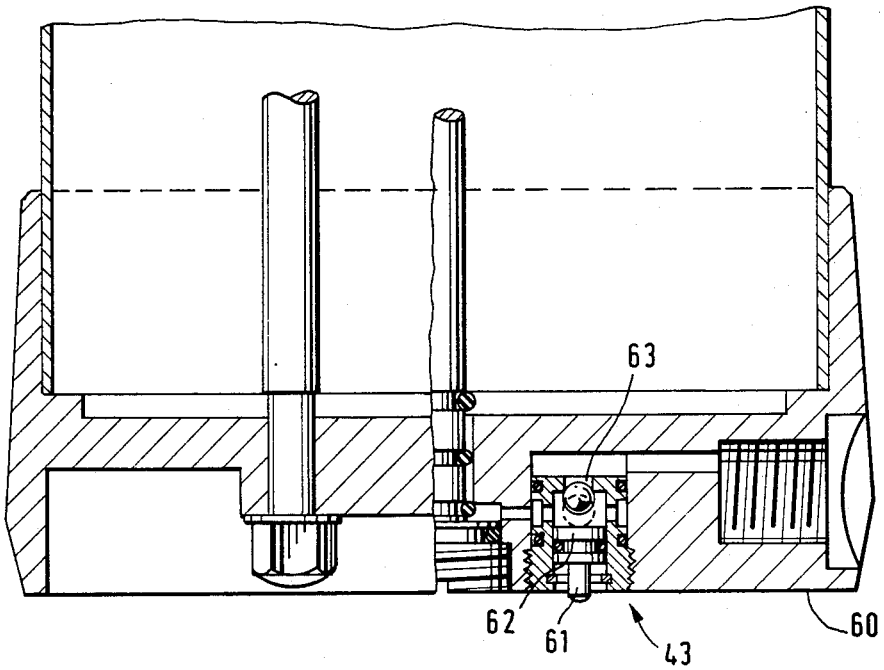
FIG. 3 is a detail of the structure shown in FIGS. 1 and 2, illustrating a shut-off valve for shutting off the flow of compressed air to the tool when it is put down.

Reference will now be made to FIG. 3 showing on an enlarged scale a shut-off or closure valve for automatically interrupting the feed of compressed air into the tool, in the position in which the tool has been set down on a surface on which it is to stand, when the tool is not in operation.

More specifically therefore, when the rivet setting tool illustrated is put down on to a surface in such a way that it stands on the underneath surface 60 of its housing, a push rod 61 which projects downwardly out of the underneath surface 60 of the housing is urged inwardly thereof, that is to say upwardly in FIG. 3, and as a result a valve ball disposed in a seating means 62 is pressed against an opening 63 so that the valve ball closes the opening 63 and the compressed air can no longer flow into the tool. That not only avoids unnecessary wastage of compressed air, but it also prevents the compressed air from continuously flowing through and out of the tool, as will constantly occur when the tool is in the condition shown in FIG. 1, the air flowing past the adjusting valve 110 and into the chamber 106. While it might be possible to prevent that flow of compressed air through the tool by closing the adjusting valve 110, it would be disadvantageous constantly to alter a pressure setting, once it has been set, by means of the air adjusting screw member 20, and it would also be much too tedious and time-consuming constantly to close the rotary valve 110 by way of the adjusting screw member 20, in order to shut off the flow of compressed air. Instead, the valve assembly shown in FIG. 3 provides that the flow of compressed air into and through the tool is shut off practically automatically by way of the actuating push rod 61, when the tool is stood on its surface 60.

It will be appreciated that the above-described embodiment of the apparatus according to the invention has been set forth solely by way of example of the principles thereof and that various modifications and alterations may be made therein without thereby departing from the spirit and scope of the invention.

I claim:

1. A rivet setting tool for setting rivet nuts comprising: a tool body including a handle portion; a pressure fluid inlet means associated with said handle portion; a forward feed means in said tool body adapted to be actuated for an upsetting operation and to impart an axial movement to the rivet pin, including a piston-cylinder means having a pressing piston and a working piston; and means for producing return movement of said pistons from the actuated to the rest condition thereof by conducting pressure fluid to the rear sides thereof, including pressure fluid passage means extending from said pressure fluid inlet means through said handle portion to a rearward chamber at said rear side of said working piston in said tool body, a valve actuating rod wherein said pressure fluid passage means comprises a first portion which passes through said valve rod and a second passage portion in said handle portion, said first and second portions communicating with each other in a first unactuated position of said valve rod, an actuating member connected to said valve rod wherein upon actuation of said actuating member whereby when said valve rod is moved into a second actuated position a communication is established between said rearward chambers of said working piston and said pressing piston with a vent opening.

2. A tool as set forth in claim 1 wherein in said first position of said valve rod said pressure fluid passage means communicates with a rearward chamber at the rear side of said pressing piston.

3. A tool as set forth in claim 1 wherein said pressure fluid passage means includes a passage portion in said tool body, said passage portion including a valve adapted to communicate a compressed air feed passage in said body with an annular space therein rearwardly of a rivet-clamping chuck means of the tool so that a pin which is torn off in a rivet setting operation is removed from the tool through a discharge passage means.

4. A rivet setting tool for setting rivet nuts comprising: a tool body including a handle portion; a pressure fluid inlet means associated with said handle portion; a forward feed means in said tool body adapted to be actuated for an upsetting operation and to impart an axial movement to the rivet pin, including a piston-cylinder means having a pressing piston and a working piston; and means for producing return movement of said pistons from the actuated to the rest condition thereof by conducting pressure fluid to the rear sides thereof, including pressure fluid passage means extending from said pressure fluid inlet means through said handle portion to a rearward chamber at said rear side of said working piston in said tool body, including a rivet-clamping chuck means aligned with said piston-cylinder means, said pressure fluid passage means including a passage portion in said tool body, said passage portion including a valve adapted to communicate a compressed air feed passage in said body with an annular space therein rearwardly of said rivet-clamping chuck means of the tool so that a pin which is torn off in a rivet setting operation is removed from the tool through a discharge passage means, said valve is in the form of a rotary valve permitting stepless control of the force for removing said torn-off rivet pin.

5. A tool as set forth in claim 1 wherein said rotary valve includes for adjustment thereof a cap nut embracing the head end of the tool.

6. A tool as set forth in claim 1 wherein said rotary valve carries an air adjusting screw.

7. A rivet setting tool for setting rivet nuts comprising: a tool body including a handle portion; a pressure fluid inlet means associated with said handle portion; a forward feed means in said tool body adapted to be actuated for an upsetting operation and to impart an axial movement to the rivet pin, including a piston-cylinder means having a pressing piston and a working piston; and means for producing return movement of said pistons from the actuated to the rest condition thereof by conducting pressure fluid to the rear sides thereof, including pressure fluid passage means extending from said pressure fluid inlet means through said handle portion to a rearward chamber at said rear side of said working piston in said tool body, closure valve means adapted to automatically interrupt the supply of compressed air to the tool when the tool is set down.

8. A tool as set forth in claim 1 wherein said closure valve means includes an actuating member projecting at the underside of a casing portion enclosing said pressing piston, thereby to actuate said closure valve means for interrupting the supply of compressed air when the tool is set down on a surface.

9. A tool as set forth in claim 8 wherein said actuating member is an actuating push rod.

* * * * *